United States Patent [19]

Hurst

[11] 4,093,478

[45] June 6, 1978

[54] ACTIVATED AMMONIUM NITRATE EXPLOSIVE COMPOSITION

[75] Inventor: Gerald L. Hurst, Dallas, Tex.

[73] Assignee: Tyler Holding Company, Dallas, Tex.

[21] Appl. No.: 759,948

[22] Filed: Jan. 17, 1977

Related U.S. Application Data

[60] Continuation of Ser. No. 312,833, Dec. 7, 1972, which is a division of Ser. No. 79,096, Oct. 8, 1970, Pat. No. 3,722,410.

[51] Int. Cl.[2] ..... C06B 45/00

[52] U.S. Cl. ..... 149/2; 149/46; 149/55; 149/89; 149/105

[58] Field of Search ..... 149/46, 55, 47, 89, 149/105, 2

[56] References Cited

U.S. PATENT DOCUMENTS

| | | | |
|---|---|---|---|
| 3,133,844 | 5/1964 | Royer et al. | 149/89 X |
| 3,279,965 | 10/1966 | de Brancion | 149/46 |

*Primary Examiner*—Stephen J. Lechert, Jr.
*Attorney, Agent, or Firm*—Richards, Harris & Medlock

[57] ABSTRACT

An economical and effective explosive composition is manufactured by combining appropriate proportions of activated ammonium nitrate, a fuel and preferably a sensitizer. The preferred fuel is a liquid hydrocarbon derivative or a liquid or solid hydrocarbon derivative which is soluble in the sensitizer and which has a fuel value greater than that of the sensitizer. The preferred sensitizers are nitroalkane, or dinitroaromatic compounds most preferably nitromethane. The explosive composition is made more effective through an activation procedure upon the ammonium nitrate. The ammonium nitrate utilized with the present invention is in the form of prills, porous spherical pellets. These prills can be activated by adding a small amount of water to the prills, thoroughly mixing the water so that it is all absorbed, heating the prills to an elevated temperature, evaporating the water from the prills, and then preferably cooling the prills.

22 Claims, 1 Drawing Figure

ACTIVATED AMMONIUM NITRATE EXPLOSIVE COMPOSITION

BACKGROUND OF THE INVENTION

This is a continuation of copending U.S. application Ser. No. 312,833, filed Dec. 7, 1972, which is a divisional of U.S. application Ser. No. 79,096, filed Oct. 8, 1970, now U.S. Pat. No. 3,722,410 issued Mar. 27, 1973.

This invention relates to an explosive and a method for manufacturing explosives. More particularly, the invention relates to a two component, liquid-solid, ammonium nitrate based explosive.

The explosives industry has been for a long time striving for a general purpose explosive and an explosive with substantial brisance which is detonable by a small cap, for example, a number 6 explosives cap. This type of explosive has been manufactured and sold, however, it generally has been uneconomical in the sense that the components of the explosive required to sufficiently sensitize the explosive composition to a number 6 cap are expensive. Another drawback to such an explosive has been that it is extremely sensitive and must be shipped in commerce under the explosives regulations. This again decreases the economic feasibility of use of such an explosive tp all but a few consumers. Hence, most general purpose explosives and explosives with substantial brisance are not the type which are detonable by a number 6 cap but require a priming charge. Again, the priming charge causes additional expense in using the explosive.

One way in which explosive manufacturers have thus far tried to circumvent the foregoing problems is to ship an oxidizing composition such as ammonium nitrate separately from a fuel. The two are then intermixed at the site of use to create an explosive mixture. All of these compositions, however, have had the drawback that they are not number 6 cap sensitive, but require a primer explosive. For example, U.S. Pat. No. 2,892,377 discloses a sealed container of ammonium nitrate. At the site of use a liquid fuel is injected into the container. The thus formed explosive can be exploded with the aid of a detonator charge. However, the composition disclosed therein is not capable of detonation with a number 6 cap.

Other attempts to make an explosive which is detonable by a number of 6 cap have included the utilization of a sensitizing fuel such as a nitroalkane. Some of these attempts have been successful in that an explosive mixture detonable by a number 8 cap can be manufactured. These compositions also have drawbacks. For example, in order to cause the energy released by such a composition to be anywhere near maximum (that is to be oxygen balanced) a substantial amount of nitroalkane is necessary. The best sensitizing nitroalkane, of course is nitromethane. In order to obtain a powerful explosive composed of nitromethane, for example, and ammonium nitrate, for example, the mixture must contain substantial nonabsorbed liquid. If in the use of such a composition cap, for example a number 6 cap, is inserted into the mixture below the liquid level line, the composition will not detonate upon explosion of the number 6 cap. However, if the cap for such an explosive is positioned above the liquid level, detonation may or may not occur. The undesirable effect of this phenomenon is that in the normal use of explosives such care in positioning the number 6 cap cannot and is not always taken, thus occasionally resulting in nondetonation upon explosion of the number 6 cap. Such an occurrence, of course, is undesirable from a safety standpoint, and from the standpoint of the manufacturer who is desirable of producing an explosive which will detonate under any condition with a number 6 cap.

Other attempts at producing a more sensitive explosive have included the process of activating or supersensitizing the oxidizing material such as ammonium nitrate. For example, in U.S. Pat. No. 3,388,014 there is disclosed a method for activating ammonium nitrate. Briefly, the method includes the steps of cycling the ammonium nitrate at a low moisture content through the 32.1° C. crystalline phase transition. This patent discloses that such cycling will decrease the density and increase the sensitivity of ammonium nitrate to detonation. It must be realized, however, that on a commercial scale, multiple cycles from below 32.1° C. to about 32.1° C. on commercial quantities of ammonium nitrate will result in great expenditures of heat energy. In addition, apparently precise control is necessary to obtain a sensitized ammonium nitrate. Additionally, foreign nucleating agents or seed crystals must be added during the process of making ammonium nitrate prills in order to successfully cycle the prill. This again requires the utilization of a special ammonium nitrate or alternatively requires an explosives manufacturer to produce his own ammonium nitrate, as such ammonium nitrate prills formed around seed crystals are not readily available at commercially attractive prices.

Thus, it is desirable to possess an explosive which is sensitive to a number 6 blasting cap. Secondly it is desirable to possess an explosive composition which can be shipped in commerce as a nonexplosive. It is further desirable to have an explosive which is a two component explosive, preferably one being a liquid component and the other being a solid component. It is further desirable to possess a two component explosive composition which is mixed by the ultimate consumer or by a local distributor which can be easily mixed and combined. It is also desirable to possess a two component explosive, one component being liquid, the other component being solid which has a low cost while remaining number 6 cap sensitive.

SUMMARY OF THE INVENTION

The foregoing desirable attributes of an explosive are fulfilled by the present invention. The present invention broadly provides an economical, low cost, number 6 cap sensitive, explosive composition which can be shipped in commerce in two components, one liquid and one solid, and which can be easily mixed at the use situs. Certain preferable forms of the two component explosive are self-mixing, thus requiring no shaking or physical intermixing of the two components.

The present invention, therefore, provides a method of producing activated ammonium nitrate prills comprising combining a nondissolving proportion of a solvent for ammonium nitrate with ammonium nitrate prills, heating the prills to an elevated temperature, and evaporating substantially all of the solvent from the prills. The invention provides an explosive mixture detonable by a commercial number 6 cap comprising activated ammonium nitrate prills and a fuel selected from hydrocarbon derivatives having an oxygen equivalent weight less than about 4 grams per equivalent, preferably less than about 3.5 grams per equivalent and most preferably less than about 3 grams per equivalent. A sensitizer selected from an organic compound containing nitrogen-oxygen bonds preferably a lower nitroaromatic compound or a nitroalkane, most preferably nitromethane, can be substituted for or used conjunctively with the fuel.

Furthermore, the invention provides a container for the solid component of the two component mixture comprising an enclosure for holding a predetermined amount of solid component of an explosive mixture, and means in said enclosure for admitting a liquid component thereto. The method for detonating the two component explosive mixture of the present invention comprises adding to the activated ammonium nitrate prills a liquid component selected from a hydrocarbon derivative having an equivalent weight less than about 4 grams per oxygen equivalent, an organic compound containing nitrogen-oxygen bonds, or mixtures of the foregoing compounds.

BRIEF DESCRIPTION OF THE DRAWINGS

A better understanding of the invention can be derived by reference to the ensuing specification in conjunction with the accompanying drawings wherein.

DESCRIPTION OF PREFERRED EMBODIMENTS

Figure 1:
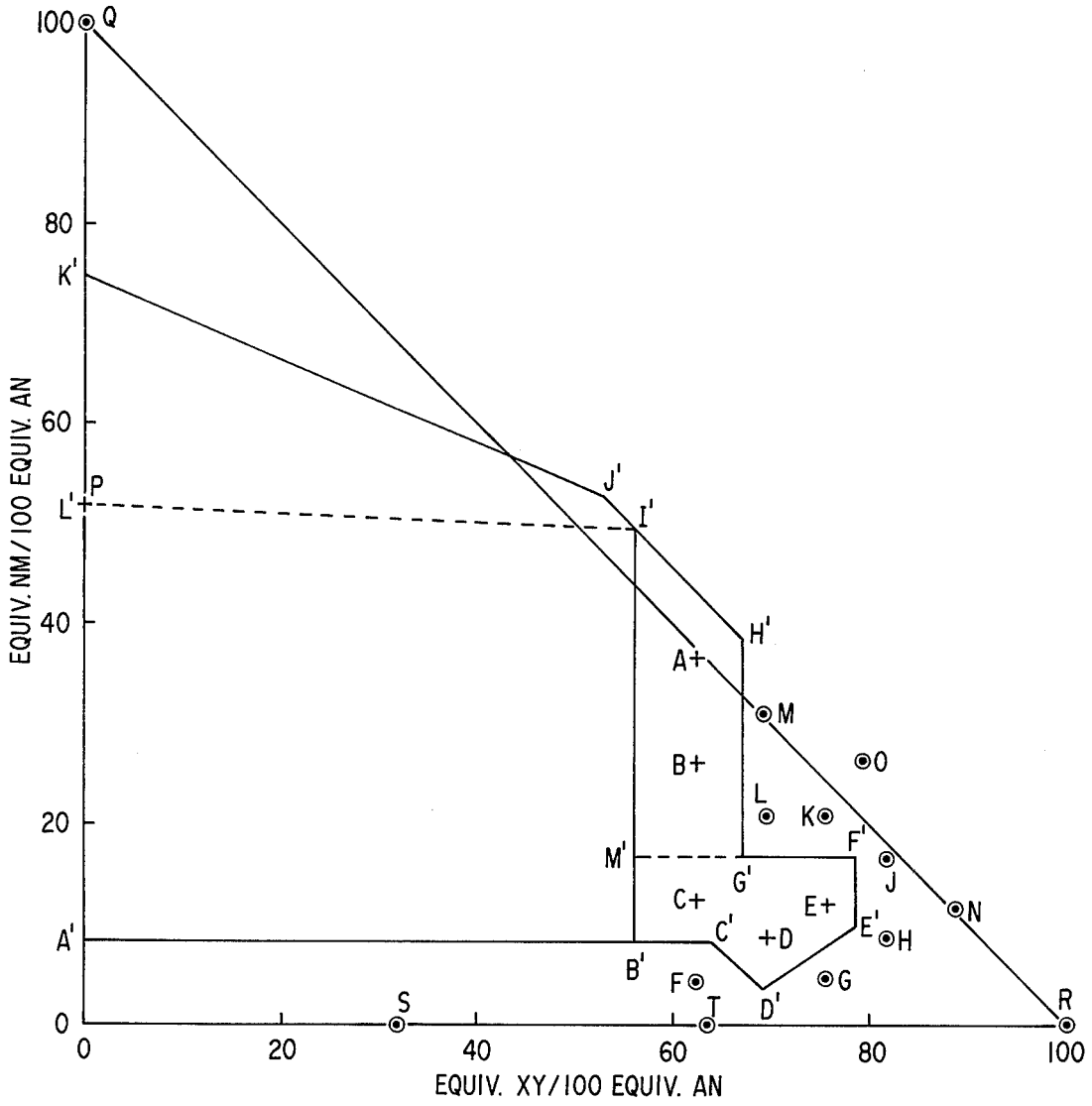
FIG. 1 is a graph of number 6 cap detonable compositions prepared in accord with the invention.

The present invention provides a two component explosive which is composed of a liquid component and a solid component. Each of these components forms a non-cap sensitive composition which can be shipped in commerce without the normal restrictions and expense applied to compositions rated as explosives. The invention relates to the activation of the solid component of the two component explosive. By activation it is meant making the explosive composition more sensitive to detonation by a low energy cap such as a number 6 explosive cap. Although the aspects of the present invention will be described in terms of preferred embodiments, it is to be understood that many equivalents, substitutions, alterations, and other variations can be made upon the invention as defined in the appended claims without departing from the intention thereof.

Accordingly, the preferred explosive composition includes a first liquid fuel and sensitizer component which can be conveniently stored and transported in a bottle or other container to its site of use. The liquid component of the explosive of the present invention preferably comprises a first composition supplied primarily as a fuel and a second composition provided primarily for its sensitizing effect on the solid component of the explosive of the present invention. The sensitizing component is preferably present; however, as will be seen later, for certain levels of activation of the solid component no sensitizer is necessary. The sensitizing component includes the organic compositions containing relatively substantial amounts of nitrogen and oxygen bonded together. The preferred compositions containing N-O bonds are the nitroalkane compositions which have three carbon atoms or less and the dinitroaromatic single ring compounds. Most preferably nitromethane and the dinitrotoluene oils are utilized.

The fuel component of the preferred form of the present invention must be one which is soluble in the sensitizing composition or nitroalkane composition. The preferable fuel compositions which are mutually soluble in the nitroalkanes and dinitrotoluene oils include the aromatic hydrocarbons, particularly those having less than about 9 carbon atoms. Examples of these aromatics are benzene, toluene, the xylenes (including o-, m- and p-xylene, and ethylbenzene) and other alkyl substituted benzene compositions. It has further been found that high molecular weight aromatic compositions such as aromatic petroleum naphthas are also particularly effective for use as a fuel with the liquid component of the explosives mixture. All of the fuel compositions need not be of high purity, as commercial grades of these different compositions will effectively formulate to produce an explosive composition. An example of a petroleum naphtha which will effectively produce an explosive composition is one sold under the trade name "SC-150," available from Texas Solvents, Dallas, Texas.

In addition, it has been found that certain oxygenated and nitrogenated organic compounds such as the lower alcohols, esters, ketones, acids, aldehydes, ethers, and amines will also provide an explosive mixture in combination with a nitroalkane or dinitrotoluene sensitizer. In addition, certain lower aliphatic compounds and mixtures such as gasoline will also provide a sufficiently active fuel to produce an explosive composition which is detonable with a number 6 explosive cap if they are used within their solubility limits or are further solubilized by an oxygenated organic compound such as butyl acetate. Regardless of the fuel composition, however, it should have a weight of less than about 4 grams per equivalent, preferably less than about 3.5 grams, and most preferably less than about 3 grams.

The solid component of the explosive mixture of the present invention is composed of ammonium nitrate. Ammonium nitrate as an oxidizer is commercially available in the form of prills, porous spherical particles. As commercially available, ammonium nitrate prills have a density commonly greater than about 0.80 grams per cc. In addition, their oil retention, calculated as hereinafter set out, is generally about 10% or less by weight. It has heretofore been thought that the potentially most desirable ammonium nitrate-fuel and ammonium nitrate-fuel-sensitizer mixtures from the standpoint of price, oxygen balance, energy release and non-toxicity of the explosion products were generally not detonable by a number 6 cap; it was thought that a primer charge was necessary to detonate such mixtures. However, it has been found that certain desirable specifically defined mixtures will detonate with a number 6 cap utilizing the activated ammonium nitrate prills of the present invention and commercial grade fuels or mixtures of fuels and sensitizing agents.

As an example, refer to FIG. 1 which is a plot of certain compositions containing lightly activated ammonium nitrate prills found to be detonable by a number 6 cap. The ordinate in FIG. 1 is a scale from 0 to 100 of oxygen equivalents of nitromethane per 100 equivalents of ammonium nitrate. The abscissa is a plot of oxygen equivalents of xylene per 100 equivalents of ammonium nitrate. Thus, the 45° line between 100 on each of the ordinate and abscissa is the oxygen balance line, meaning that no excess of xylene and nitromethane is present in relation to the ammonium nitrate oxidizer for compositions falling on the 45° line. Of course, it is understood that maximum energy is released by a given composition if it falls near the oxygen balance line. Any composition being less than oxygen balanced, that is, having less nitromethane or xylene than is required to bring the composition to the oxygen balance line will not have or will not release the same amount of energy as will an oxygen balanced mixture. Anything outside (or above) the vicinity of the oxygen balance line in terms of nitromethane or xylene, will merely cause fuel waste, as there will be excess fuel in relation to the amount of oxygen present. It is also to be understood that a less than oxygen balanced mixture is for certain applications not undesirable. For example, the composition labeled "C" would not be an optimal explosive for moving objects such as boulders, tree stumps or the like. However, the explosive mixture labeled "C" does have substantial brisance, that is, the shattering or crushing effect of the explosive composition. Such a composition as is labeled "C" when exploded in near proximity to a boulder of, for example limestone or granite, will shatter the boulder into a number of small pieces. This effect is, of course, desirable in many quarrying operations.

As stated above, it has been found that certain hydrocarbon-nitroalkane-ammonium nitrate compositions or hydrocarbon-dinitroaromatic hydrocarbon-ammonium nitrate compositions (using activated ammonium nitrate prills) are detonable with a number 6 cap which heretofore have been thought to be detonable only with a much larger cap or primer charge. Such compositions using nitromethane, xylene and lightly activated ammonium nitrate prills are labeled as A, B, C, D, and E on the plot in FIG. 1. These compositions were activated with 0.5% by weight water in accord with the present invention as set forth below. Other compositions not detonable by a number 6 cap, using similarly activated ammonium nitrate, are labeled F, G, H, J, K, L, M, N, O, Q, and R. In addition, it has been found that a mixture of nitromethane alone labeled "P" on the diagram containing about 52 equivalents of nitromethane per 100 equivalents of ammonium nitrate is also detonable with a number 6 cap. However, this composition is less desirable than, for example, composition E since it is not near the oxygen balance line. Composition P is also less desirable because nitromethane and other nitroalkanes are much more expensive than are the aromatic hydrocarbon fuels. A composition labeled "Q" which is oxygen balanced only with nitromethane is not detonable by a number 6 cap for all cap positions. Likewise, the compositions labeled "R," "S" and "T" on FIG. 1 containing only xylene are not detonable with a number 6 cap.

It has been found that compositions containing lightly activated ammonium nitrate prills within the polygon A', C', D', E', F', G', H', J' and K' are detonable with a number 6 cap. However, those compositions containing more than about 50 equivalents of nitromethane per 100 equivalents of ammonium nitrate corresponding to the compositions above the line I', L' and yet within the aforementioned polygon are less desirable because the composition becomes too wet. That is, the lightly activated ammonium nitrate cannot absorb all of the liquid fuel including nitromethane and xylene which are required to bring it within the appropriate compositional mixture. If a number 6 cap, for example, is inserted below the liquid level line of the composition (the free liquid level) the number 6 cap is not capable of detonating the mixture. However, if the number 6 cap is placed above the free liquid level line, the number 6 cap may detonate those compositions within the polygon L', I', J', K'. Those compositions falling within the smaller polygon B', C', D', E', F', G', H', I' are the most preferred since they all are very near the oxygen balance line and also comprise a mixture which is not at all wet, that is, does not contain excess free liquid component. The compositions falling within the yet smaller polygon G', H', I', M' are the most preferred since they are essentially self mixing, that is, the capillary action and absorptivity of the ammonium nitrate coupled with these fuel compositions will completely permeate the ammonium nitrate without leaving any free liquid and without the necessity for shaking, stirring, or any sort of mixing. Those compositions within the polygon B', C', D', E', F', M' do require some shaking or mixing prior to attempting a detonation with a number 6 cap. It is to be understood that the areas within the polygons of FIG. 1 represent only the initial preferred limits of the invention for minimally activated ammonium nitrate prills. Compositions containing amounts of nitromethane and xylene outside the polygons can be made to work depending upon the degree of activation of the ammonium nitrate as will be explained hereinafter.

It has been found that if the density of commercial ammonium nitrate prills can be decreased, and more importantly, the oil absorptivity or oil retention as determined by the test outlined below, can be increased, the number of combinations of compositions of sensitizer, fuel and ammonium nitrate which can be detonated by a number 6 cap can be greatly expanded. The activation procedure is a relatively simple operation which can be performed on any commercial ammonium nitrate prill. The activation procedure includes adding a very minor proportion of water to ammonium nitrate prills, heating them to an elevated temperature, and drying the prills to a water content substantially the same as that originally present in the ammonium nitrate prills. The water which can be added originally to the ammonium nitrate prills can range generally between about 0.3% by weight and 6% by weight. If much less than 0.3% by weight of water is added to the prills, followed by the subsequent heating and drying, little or no activation of the ammonium nitrate takes place. If much greater than 6% by weight of water is added to the ammonium nitrate prills, undesirable dissolution of the prills in the water begins to take place. Such dissolution is not desirable since it is imperative to retain the prills in their original spherical form. A most preferred amount of water to be added to the ammonium nitrate prills will range between about 0.5% to about 5% by weight. Preferred temperatures to which the ammonium nitrate prills are heated and at which they are dried ranges from about 40° C. to about 130° C. The prills are dried to a moisture content of less than about 0.2% by weight and preferably to less than 0.1% by weight.

It has been found that the foregoing activation procedure will reduce the untamped bulk density of the ammonium nitrate prills by more than 10%. Adding a greater percentage of water within the foregoing range will produce a proportionate decrease in density while providing a proportionate increase in the oil retention capability of the ammonium nitrate prills. As set forth in the examples, a composition which has been activated by the foregoing procedure will detonate with a number 6 cap even if no sensitizing composition in the liquid component is utilized. For example, in FIG. 1, the composition labeled "T," which is straight xylene mixed with ammonium nitrate, will not detonate with a number 6 cap using normal commercially available or lightly sensitized ammonium nitrate prills. However, after the composition has been subjected to the foregoing activation procedure. using 5% water, composition "T" is detonable with a number 6 cap. By subjecting the ammonium nitrate prills to the foregoing procedure, the oil retention of the prills can be increased to greater than about 10% by weight. Preferably, oil retention is increased to greater than about 20% by weight.

Although an exact theory cannot be proferred, it is believed that the foregoing activation process is not a function of phase change, but rather is dissolution of a portion of the ammonium nitrate prills and a recrystallization of the dissolved portion. A theory by which the activation procedure takes place is as follows. A minor proportion of water is absorbed by the ammonium nitrate prills and penetrates the small voids and interstices on the interior of the prill structure. Of course, at low temperatures, the solubility of ammonium nitrate is low. It is believed that at the low temperatures (for example, room temperature) a saturation amount of ammonium nitrate is dissolved in the water as it proceeds to the interior of the prills. As the prills are then heated to an elevated temperature, the water on the interior of the prills contacting the walls of the voids and interstices can dissolve and solubilize greater and greater amounts of the ammonium nitrate. As the temperature continues to rise and as the water evaporates from the surface of the prills, capillary action drives liquid containing solubilized ammonium nitrate to the exterior of the prills. The water is then evaporated from the exterior of the ammonium nitrate prills redepositing ammonium nitrate on the exterior surface of the prills, thus leaving larger voids and interstices in the prills while physically increasing the size of the prills by redeposition of ammonium nitrate on the prill surface. The oil retention capability and actual bulk of the ammonium nitrate prills are increased allowing better interface contact between the fuel and sensitizer and the solid oxidizing component of the explosive composition. Although it is believed that this is the mechanism by which the foregoing activation procedure effectively increases the reactivity of the ammonium nitrate, it is not intended that the disclosure and invention should be limited by this theory.

EXAMPLES

The following examples are presented to further enable one of ordinary skill in the art to reproduce the present invention. In addition, they set out preferred modes of carrying out the foregoing. They are not intended in any manner to be delimitative of the invention, but are intended only as exemplary. All percentages used herein are by weight.

When an oil retention figure is given in the examples and throughout this specification, it is determined by the following test. 100 grams of ammonium nitrate which is +18 United States mesh or greater is placed in a 140cc polyethylene bottle. The sample is weighed. Thereafter the bottle is filled to the lip with commercial grade xylene. The ammonium nitrate prills are allowed to soak in the xylene for about 5 minutes. Thereafter the bottle and sample are inverted on a screen and allowed to drain for 15 minutes. The polyethylene bottle is periodically squeezed during the drain period to prevent entrainment of liquid between the particles. The bottle, sample and absorbed or retained xylene is again weighed. The increase in weight is calculated and expressed as percent oil retained or percent retention by the following formula:

$$\frac{\text{weight of sample plus absorbed oil} - \text{weight of original sample}}{\text{weight of original sample}} \times 100\% = \%\ \text{oil retention.}$$

EXAMPLE I

Commercial explosive grade ammonium nitrate prills weighing 1000 grams (identified by the trademark "Nitro-Carbo-Nitrate" available from Trojan-U.S. Powder, a Division of Commercial Solvents Corporation, 260 Madison Avenue, New York, New York 10016) having an oil retention of about 10% and a density of about 0.89 grams per cc are admixed with about 40 grams of xylene and about 185 grams of nitromethane. The mixture is self-wetting. The resultant mixture is formed into a charge and a number 6 cap connected to a 1 minute fuse is inserted into the mixture. Upon exploding the number 6 cap, the charge fails to detonate.

EXAMPLE II

A sample of commercial grade ammonium nitrate prills identical to that used in Example I weighing 1000 grams having an initial moisture content as purchased of about 0.1% is placed in a glass beaker. Five grams of water (0.5% by weight based on the amount of ammonium nitrate) is added to and thoroughly mixed with the ammonium nitrate prills. The prills and intermixed water are then placed in an oven and heated to a temperature of about 80° C. The prills are maintained at that temperature for about 30 minutes until they are dried to a moisture content of less than 0.2%. The prills are then removed from the oven and cooled to room temperature.

The original density of the prills prior to the foregoing treatment is 0.89 grams per cc. The density after being subjected to the foregoing treatment is 0.73 grams per cc, including fines. The oil retention of the original ammonium nitrate prills is about 10%. The oil retention of the prills after undergoing the foregoing treatment is about 20%.

The above treated sample, weighing about 1000 grams, is mixed with about 40 grams of xylene, commercial grade, and about 185 grams of nitromethane, commercial grade. The ammonium nitrate is self-wetting, i.e., capillary action and the absorptivity of the ammonium nitrate prills cause the liquid to travel throughout and completely wet the prills without shaking or mixing.

The resulting explosive mixture is formed into a charge and a number 6 cap connected to a 1 minute fuse is inserted into the mixture. The mixture is placed on a limestone boulder (having a size of approximately 2 cubic yards). Upon exploding the number 6 cap, the charge detonates with a loud report and substantial brisance. The charge shatters the boulder into particles having a mean diameter of less than about 5 inches. The foregoing procedure is designated Test "A" and is so plotted and identified in FIG. 1.

The foregoing procedure is again repeated utilizing different amounts of xylene and nitromethane. These tests are designated "B," "C," "D," "E," "F," "G," "H," "J," "K," "L," "M," "N," "O," "P," "Q," "R," "S," and "T." The results of these tests are also set forth in FIG. 1. The 0 symbols represent only partial or no detonation with a number 6 cap. The + symbols represent detonation with a number 6 cap accompanied by substantial brisance. As is readily seen, only certain mixtures of xylene, nitromethane and ammonium nitrate activated with 0.5% water will detonate with a number 6 cap.

EXAMPLE III

The activation procedure of Example II is repeated utilizing 1000 grams of the same ammonium nitrate prills. In this example, 50 grams of water (5% by weight) are added and thoroughly mixed with the ammonium nitrate prills. The prills are then placed in an oven and heated to a temperature of about 60° C. The prills are maintained at that temperature for about 30 minutes and until they are dried to a moisture content of about 0.1%. The prills are then removed from the oven and cooled to room temperature.

The original density of the prills is 0.89 grams per cc. The density after being subjected to the foregoing activation procedure is 0.56 grams per cc. The original oil retention of the ammonium nitrate prills is about 10% whereas the oil retention of the thus activated ammonium nitrate prills is about 30% by weight.

The activated ammonium nitrate prills, weighing 1000 grams, are mixed with about 25 grams of xylene. The xylene is thoroughly intermixed with the ammonium nitrate prills. The resulting mixture is formed into a charge and a number 6 cap is inserted into the mixture and connected to a 1 minute fuse. The charge is placed on a limestone boulder of approximately 1 cubic yard. Upon exploding the number 6 cap, the charge detonates with a loud report and shatters the boulder into particles having a mean diameter of about 10 inches.

EXAMPLE IV

The procedure of Example III is repeated except that the activated ammonium nitrate prills are admixed with about 10 grams of toluene and about 150 grams of nitromethane.

Upon forming the foregoing mixture into a charge and detonating it with a number 6 cap, substantial brisance is noted along with a loud report. A limestone boulder of approximately 2 cubic yards is shattered into pieces having a mean diameter of less than about 10 inches.

EXAMPLE V

The procedure of Example III is repeated except that the activated ammonium nitrate prills are admixed with about 100 grams of nitropropane. The results upon detonation with a number 6 cap are substantially the same as those obtained in Example IV.

EXAMPLE VI

The procedure of Example II, composition "A," is repeated except that 40 grams of benzene is substituted for the 40 grams of xylene. Upon exploding a number 6 cap in the mixture, the results are substantially the same as Example II.

EXAMPLE VII

The procedure of Example VI is repeated substituting 40 grams of toluene for the benzene. Upon detonation with a number 6 cap, the results are substantially the same as those obtained in Example VI.

EXAMPLE VIII

The activation procedure of Example II, composition "A," is repeated except that 10 grams of water are added to 1000 grams of explosive grade ammonium nitrate prills (1% by weight based on the original prills). The water is thoroughly admixed with the ammonium nitrate. The mixture is then placed in an oven and heated to a temperature of about 100° C. The prills are maintained at that temperature for about 30 minutes and dried to a moisture content of less than 0.1%. The prills are then removed from the oven and cooled to room temperature. The original density of the prills is 0.89 grams; the density after being subjected to the foregoing treatment is about 0.68 grams. The original oil retention of the ammonium nitrate prills is about 10%. The oil retention after being subjected to the foregoing activation procedure is about 25%.

The thus activated ammonium nitrate prills, still weighing about 1000 grams, is mixed with 40 grams of xylene and 185 grams of nitromethane. The ingredients readily self-mix. The resulting mixture is formed into a charge and a number 6 cap connected to a 1 minute fuse is inserted into the mixture. The charge is placed on a limestone boulder of about 2 cubic yards in size. Upon exploding the number 6 cap, the charge detonates with a loud report and substantial brisance. The charge shatters the boulder into particles having a mean diameter of less than about 6 inches.

EXAMPLE IX

The procedure of Example II, composition "A," is repeated except that 20 grams of water (2% by weight) are added to the ammonium nitrate prills. The original density and oil retention of the ammonium nitrate prills is 0.89 grams per cc and 10%, respectively. After the activation procedure, the density is 0.62 grams per cc and the oil retention is about 27%.

Upon being mixed with 40 grams xylene and 130 grams nitromethane, the resultant mixture is formed into a charge and detonated with a number 6 cap. The charge detonates with a loud report and shatters a limestone boulder of about 2 cubic yards into particles having a mean diameter of less than about 6 inches.

EXAMPLE X

The procedure of Example II, composition "A," is repeated except that about 40 grams of methanol are substituted for the xylene. Substantially the same results are obtained.

EXAMPLE XI

The procedure of Example II, composition "A," is repeated except that about 84 grams of methanol (same oxygen balance as about 40 grams of xylene) are substituted for the xylene. The shattering results on a 2 cubic yard boulder are inferior to those obtained with 40 grams of xylene. For applications requiring maximum energy release and brisance, the alcohol is inferior to xylene.

EXAMPLE XII

The procedure of Example II, composition "A," is again repeated except that 60.7 grams of ethyl alcohol (same oxygen balance as 40 grams of xylene) are substituted for the xylene. Upon detonating with a number 6 cap, only a partial detonation is obtained. Thus ethyl alcohol is inferior to xylene, although usable for certain applications.

EXAMPLE XIII

The procedure of Example II, composition "A," is again repeated except that 52.8 grams of propyl alcohol (same oxygen balance as 40 grams of xylene) are substituted for the xylene. Upon exploding a number 6 cap in the mixture, no detonation is obtained.

EXAMPLE XIV

The procedure of Example IX is repeated utilizing 40 grams of xylene and 130 grams of nitromethane. The resultant mixture is formed into a charge and placed at the center of a ½ inch steel plate about 2 feet square. The plate is supported at its four corners approximately 6 inch above the ground. Upon exploding the number 6 cap, the charge detonates with a loud report, produces a large indentation in the steel plate and causes the plate to spall on the side opposite from that on which the charge exploded. The explosive mixture has substantial power.

EXAMPLE XV

To illustrate that an activation by the method disclosed herein will take place totally within the ammonium nitrate phase above 32.1° C., 1000 grams of ammonium nitrate is placed in an oven in a glass beaker at 45° C. The initial moisture content of the ammonium nitrate is about 0.1%. The sample is left in the oven for 24 hours to assure that most of the sample has been converted to the crystalline phase above 32° C. After 24 hours at 45° C., 10 grams of hot water (74° C.) is admixed with the hot ammonium nitrate prills. The sample is immediately returned to the oven where it is dried for 1 hour at 80° C. until the moisture content is below 0.2% by weight. Thereafter the 1000 gram sample is mixed with 185 grams of nitromethane and 40 grams of xylene. The mixture is shaped into a charge and a number 6 cap inserted therein. While still above 32° C. the cap is exploded detonating the mixture. An excellent report is obtained. A ⅜ cubic yard boulder is shattered by the charge into pieces having a mean diameter less than about 4 inches.

The original density of the prills prior to undergoing the activation procedure outlined above is about 0.89 grams per cc. After the activation procedure, the prills have a density of about 0.78 grams per cc., thus indicating activation has taken place.

EXAMPLE XVI

The procedure of Example IX is repeated this time substituting about 53 grams of butyl acetate for the 40 grams of xylene. The mixture detonates upon explosion of a number 6 cap. A 1 cubic yard boulder upon which the charge is placed is shattered into pieces having a mean diameter of less than about 6 inches. The explosion has substantial brisance.

EXAMPLE XVII

The procedure of Example IX is repeated substituting 152 grams of dinitrotoluene oil and 10 grams of aromatic naphtha (SC-150) for the nitromethane and xylene. Substantialy the same results are obtained.

EXAMPLE XVIII

The procedure of Example II is repeated with all compositions found to be detonable with a number 6 cap in Examples II through XVII substituting nonactivated explosive grade ammonium nitrate prills manufactured by the Gulf Oil Company. All of the mixtures, except composition "P," fail to detonate with a number 6 cap.

EXAMPLE XIX

The procedure of Example XVIII is repeated substituting unactivated fertilizer grade ammonium nitrate prills supplied by the Gulf Oil Company. In each case the mixtures, except composition "P," fail to detonate with a number 6 cap.

EXAMPLE XX

The procedure of Example VIII is repeated substituting 1000 grams of explosive grade ammonium nitrate prills available from the Gulf Oil Company. Substantially the same results are obtained.

EXAMPLE XXI

The procedure of Example VIII is repeated substituting 1000 grams of fertilizer grade ammonium nitrate for the explosive grade ammonium nitrate. Substantially the same results are obtained.

EXAMPLE XXII

The procedure of Example III is repeated on compositions "S" and "T" of FIG. 1 utilizing 1000 grams of ammonium nitrate, dried at 75° C. Both of the compositions detonated with substantial brisance upon explosion of a number 6 cap therein.

Many variations, alterations, substitutions and equivalents applicable to the various disclosed embodiments of the present invention will be recognized by those of ordinary skill in the explosives art. It is the intent of this disclosure, however, that the concepts of this invention be limited only by the appended claims.

What is claimed is:

1. An explosive mixture comprising:

activated porous ammonium nitrate prills which have a bulk density of less than about 0.80 grams per cubic centimeter and which have been activated by combining a minor nondissolving proportion of a solvent with ammonium nitrate prills having a bulk density of greater than about 0.80 and thereafter heating the prills to an elevated temperature and evaporating substantially all of the solvent from the prills, a fuel selected from a liquid hydrocarbon derivative having an oxygen equivalent weight less than about 4 grams per equivalent, said mixture detonable by a commercial number 6 cap.

2. The mixture of claim 1 further comprising:

an organic compound containing N-O bonds.

3. The mixture of claim 2 wherein said explosive mixture has a composition within the area bounded by the polygon A', C', D', E', F', G', H', J', K' on the accompanying drawing, said fuel comprising xylene, said nitroalkane comprising nitromethane.

4. The mixture of claim 2 wherein the ammonium nitrate has an oil retention of greater than about 10% by weight.

5. The mixture of claim 4 wherein the fuel is an aromatic hydrocarbon selected from aromatic hydrocarbons having less than about 9 carbon atoms and petroleum naphthas.

6. The mixture of claim 4 wherein the organic compound containing N-O bonds is a nitroalkane having less than 4 carbon atoms.

7. The method of claim 6 wherein the organic compound containing N-O bonds is dinitrotoluene oil.

8. The mixture of claim 5 wherein the aromatic hydrocarbon is selected from xylene, toluene, benzene and mixtures thereof.

9. The mixture of claim 8 wherein the nitroalkane is nitromethane.

10. The explosive mixture of claim 2 wherein the fuel is selected from lower aromatics and substituted aromatics having less than about 9 carbon atoms and petroleum naphthas.

11. The mixture of claim 2 wherein the compound containing N-O bonds is nitromethane.

12. The mixture of claim 11 wherein less than 50% of an oxygen balancing amount of fuel is supplied by nitromethane.

13. The mixture of claim 12 wherein less than about 20% of an oxygen balacing amount of nitromethane is utilized and wherein greater than about 60% of an oxygen balancing amount of a fuel selected from xylene, benzene, toluene and petroleum naphthas is utilized.

14. An explosive mixture consisting essentially of:

activated ammonium nitrate prills having a density of less than about 0.80 grams per cubic centimeter, and a liquid fuel selected from a hydrocarbon derivative having an oxygen equivalent weight of less than about 4 grams per oxygen equivalent.

15. The mixture of claim 14 wherein said fuel is an aromatic hydrocarbon.

16. The mixture of claim 14 wherein said ammonium nitrate prills are produced by combining ammonium nitrate prills having a bulk density greater than about 0.80 grams per cubic centimeter with a minor nondissolving proportion of a solvent for ammonium nitrate prills and thereafter heating the prills to an elevated temperature and evaporating substantially all of the solvent therefrom to yield the activated porous ammonium nitrate prills having a bulk density of less than 0.80 and having an oil retention of greater than about 10% by weight.

17. The mixture of claim 16 wherein said fuel is selected from aromatic hydrocarbons having less than about 9 carbon atoms and petroleum naphthas.

18. An explosive mixture consisting essentially of activated ammonium nitrate prills which have a density of less than about 0.80 grams per cubic centimeter, and a liquid comprising an organic compound containing N-O bonds which liquid is absorbed by said ammonium nitrate.

19. The mixture of claim 18 wherein said ammonium nitrate prills are produced by combining ammonium nitrate prills having a bulk density greater than about 0.80 grams per cubic centimeter with a minor nondissolving proportion of a solvent for ammonium nitrate prills, that proportion being insufficient to destroy the spherical form of the prills and thereafter heating the prills to an elevated temperature and evaporating substantially all of the solvent therefrom to yield the activated porous ammonium nitrate prills having a bulk density of less than 0.80 and having an oil retention of greater than about 10% by weight.

20. The explosive mixture of claim 19 wherein said organic compound is selected from a nitroalkane having less than about 4 carbon atoms and dinitrotoluene oil.

21. An explosive mixture consisting essentially of activated porous ammonium nitrate prills which have a bulk density of less than about 0.80 grams per cubic centimeter, a liquid sensitizer comprising an organic compound containing N-O bonds, and a liquid fuel selected from a hydrocarbon derivative having an oxygen equivalent weight of less than about 4 grams per oxygen equivalent.

22. The mixture of claim 21 wherein said ammonium nitrate prills are produced by combining ammonium nitrate prills having a bulk density greater than about 0.80 grams per cubic centimeter with a minor nondissolving proportion of a solvent for ammonium nitrate prills and thereafter heating the prills to an elevated temperature and evaporating substantially all of the solvent therefrom to yield the activated porous ammonium nitrate prills having a bulk density of less than about 0.80 and having an oil retention of greater than about 10% by weight.

* * * * *